United States Patent [19]

Schnitzer

[11] 4,034,921

[45] July 12, 1977

[54] MILLING APPARATUS

[76] Inventor: Johann Georg Schnitzer, Feldbergstrasse 26, 7742 St. Georgen, Germany

[21] Appl. No.: 597,182

[22] Filed: July 18, 1975

[30] Foreign Application Priority Data

July 18, 1974 Germany ..... 7424515[U]
Sept. 16, 1974 Germany ..... 2444152

[51] Int. Cl.[2] ..... B02C 7/18

[52] U.S. Cl. ..... 241/157; 241/246; 241/260.1; 241/261.3

[58] Field of Search ..... 241/157, 161, 162, 246, 241/257 R, 258, 260.1, 261.1, 261.2, 261.3

[56] References Cited

U.S. PATENT DOCUMENTS

| | | | |
|---|---|---|---|
| 133,455 | 11/1872 | King | 241/162 |
| 755,989 | 3/1904 | Baker et al. | 241/246 |
| 1,415,808 | 5/1922 | Dellinger | 241/261.3 |
| 2,941,561 | 6/1960 | Pavia | 241/258 |
| 3,130,926 | 4/1964 | Schmieding | 241/260.1 |
| 3,387,795 | 6/1968 | Bidwell | 241/157 |
| 3,387,796 | 6/1968 | Cormack et al. | 241/261.3 |

*Primary Examiner*—Granville Y. Custer, Jr.
*Attorney, Agent, or Firm*—Lackenbach, Lilling & Siegel

[57] ABSTRACT

Upper and lower millstones are provided in a milling apparatus adapted to mill a wide range of cereal grains and other kernels. The upper millstone is stationary and is pierced by a central orifice through which the drive shaft of the rotating lower millstone passes. Cutting teeth protrude radially from the drive shaft in the region of the central orifice and cooperate with guide channels in the orifice wall to break kernels larger than would pass through the annulus between the shaft and the orifice, thereby supplying pre-milled kernel fragments to the opposing milling surfaces of the upper and lower millstones. Radially spiralling furrows in the milling surfaces further reduce the feed to flour, prior to discharge at the outer periphery of the milling apparatus.

19 Claims, 11 Drawing Figures

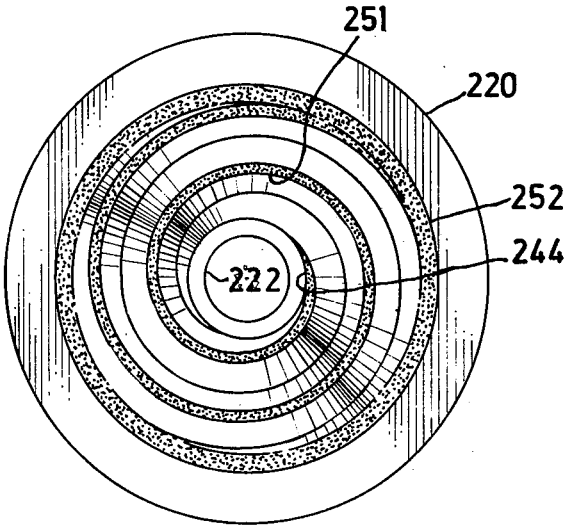
FIG.6
FIG.7
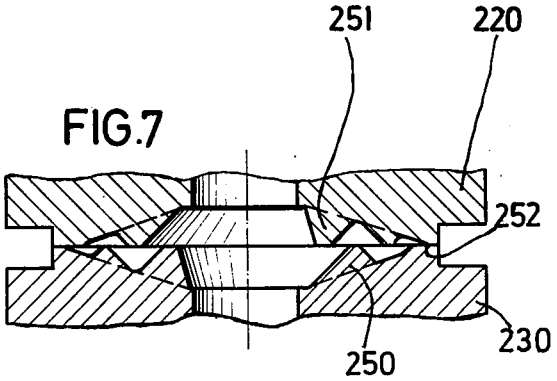

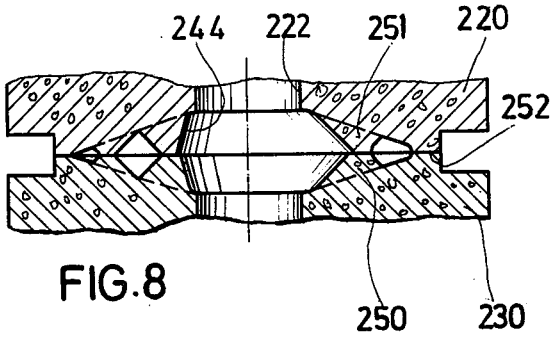
FIG.8
FIG.9
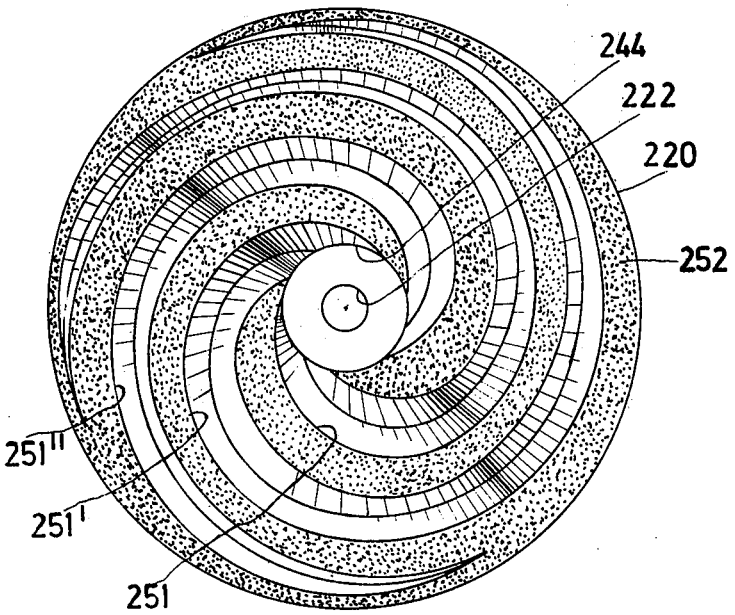

MILLING APPARATUS

BACKGROUND OF THE INVENTION

The invention relates to milling apparatus adapted to reduce a wide range of feedstock grain sizes to flour with the aid of a stationary upper millstone, provided with a central orifice for the supply of feed kernels, and a lower millstone rotated by a drive shaft. It relates, more particularly, to such apparatus wherein an initial reduction of large kernels is achieved by a primary reduction stage employing milling teeth radially protruding from the drive shaft in the region of the central orifice of the upper millstone.

Milling apparatus of this description are particularly known and used for the reduction of cereal grains and are commercially available in a wide range of sizes, including manually operated household mills and mills used in large-scale baking operations. Generally the housing in which the stationary upper millstone is located is also utilized to store and funnel the feedstock to the millstones. The feedstock is funneled from a storage chamber to the central cavity of the milling space through the aforementioned orifice in the upper millstone. The feedgrains are fed from the central cavity into the space between the millstones and the fineness of the resulting flour is controlled by the milling gap, the smaller the space between the opposing milling surfaces the finer the flours. The flour leaves the milling space at the outer periphery of the millstone and is discharged into a suitable container for further use.

In the milling of cereal grains it is paticularly important that the milling process be carefully controlled so that the feed is not excessively heated during the process. The generation of great heat can lead to the destruction of essential nutrients in the feed grain.

The milling apparatus of the prior art have a number of inherent disadvantages. One of the more serious of these disadvantages lies in their ability to accept only grains of a specified size. A cereal mill adapted to the milling of wheat, barley, rye and the like — for example — cannot be used for the reduction of feedstock with inherently larger kernel sizes, such as maize, soybeans, peas and the like. The larger kernels cannot be readily guided into the milling space between the stones, and — if the stones are shaped to accept such kernels — the large volume of the material to be mailed can lead readily to a stopping up of the milling gap. Furthermore, the milling of larger kernels in mills of the prior art is generally too rapid and leads to an unacceptable heating of the feed.

It is, therefore, a primary object of the invention to provide milling apparatus capable of accepting a wide range of feed kernel sizes.

It is a particular object of the invention to provide such milling apparatus in which the rate of size reduction of large kernels is so controlled that excessive heating or the stopping up of the milling gap is avoided.

It is a further object of the invention to provide milling apparatus of the above kind, wherein the user is not required to alter the apparatus or to provide auxiliary devices when changing from feed of one kernel size to feed of another size.

It is yet another object of the invention to provide milling apparatus adapted to the reduction to flour of a wide range of grain sizes in which the size, weight, construction cost, operating cost and maintenance compare favorably with apparatus of the prior art.

Other objects and advantages of the invention shall become apparent from the detailed description of the preferred embodiment thereof, below.

SUMMARY OF THE INVENTION

The invention attains the foregoing objects by the provision of a primary size-reduction stage through which the feed must pass prior to entering the fine-milling region of the milling apparatus.

With the aid of the size reduction stage of the invention all feedstock is reduced to the particular size adapted to the configuration of the millstones. Consequently, the feedstock is fed from the central cavity towards the milling gap with an initial size independent of the size of the individual kernels in the feed. The configuration of the milling surfaces can be, therefore, optimized to this uniform, pre-milled feed and an undesirable heating and/or stopping up in the fine-milling region can be avoided. For large feed grain kernels the milling process is undertaken in two stages; the initial pre-milling in the size-reduction stage, and the final fine-milling in the milling gap of the millstones. The pass-through time of the feedstock is, thereby, increased and an excessive heat build-up is thereby, prevented. Feedstock of small grain size passes through the size-reduction stage unimpeded, so that the milling of such feed proceeds in a single stage. In consequence, the milling period for such small grained feedstock is not increased by the action of the size-reduction stage of the invention.

In one embodiment of the invention the size-reduction stage comprises a hob mounted on the drive shaft extension as it passes through the central orifice of the upper millstone, through which grain is fed into the interspace between the millstones. The teeth of this hob extend substantially radially from the surface of the driveshaft and are interrupted by gaps. At least one feedslot is also provided in the wall of the central orifice, narrowing in the direction of feedgrain travel.

Such a very simple size-reduction stage is fully able to pre-mill feedstock with very large kernel sizes. The large grains are guided by the feedslot towards the hob where the rotating teeth of the latter intercept and break them. The interruptions in the hob teeth further ensure that such kernels are quickly and certainly engaged by the milling teeth as the kernels enter, or fall into, these interspaces. The broken kernels are permitted to drop lower in the feedslot until they are again intercepted by the teeth of the hob — pressed against them by the inward slope of the feedslot — and further reduced in size until the fragments pass through the annulus between the inner surface of the central orifice of the upper millstone and the outer perimeter of the hob.

Feedstock of small grain size, whose characteristic dimension is smaller than the aforementioned annulus, can pass through the size-reduction stage with substantially no interference.

Since the construction of this embodiment differs from the apparatus of the prior art only in the provision of the milling hob and of the feedslot, the manufacture thereof is not substantially more expensive, the apparatus is equally robust, and its operation equally reliable.

The manufacture of the hob is particularly simple if the interruptions of the teeth are arranged to form at least one continuous groove aligned with the centerline of the driveshaft.

The feeding of the kernels to the teeth of the hob is substantially improved if the grain is fed through a spiral path relative to the hob rotation. In a particular embodiment of the invention this is attained by aligning the interruptions between the individual hob teeth to form axial grooves, while the feedslots are arranged to run in a helix along the wall of the feed orifice. In another embodiment of the invention the same relationship is attained by forming the aforementioned interruptions in the hob teeth into grooves spiralling along the driveshaft, while the feedslots in the wall of the orifice are in axial alignment with the driveshaft centerline.

The width of the interruptions in the hob teeth is suitably dimensioned so that it corresponds in size to the largest of the kernels which may be supplied in the feedstock, ensuring that such kernels will be trapped between adjoining teeth and reduced in size.

In a particularly advantageous development of the milling apparatus of the invention a size-reducing stage may be provided in the faces of the millstones themselves by means of a spiral groove in one millstone extending from the central cavity towards the fine-milling region and co-operating with radial fluting in the corresponding region of the other millstone. Kernels too large in size to be fully encompassed by the dimensions of the spiral groove are pressed against the flutes of the other millstone and broken. Small-grained feedstock, on the other hand, is conveyed radially in the spiral groove without modification.

The above size-reduction stage utilizing a spiral groove in a millstone face may be used as the sole means of pre-milling large scale feedstock, or it may be combined with the previously described hob arrangement on the driveshaft. The advantages associated with the spiral groove pre-milling stage are the same as for the hob; the feed is reduced in size, the milling period is increased, and the heating of the feed reduced. The provision of a spiral pre-milling stage does not substantially increase either the size or the cost of the milling apparatus.

When both a hob and a spiral pre-milling stage are provided in the same apparatus the reduction of coarse-grained feedstocks is achieved in three stages, the reduction of a feedstock with average kernel size bypasses the hob and is pre-milled only in the spiral groove region, while feedstock with very fine grain sizes bypasses both pre-milling stages and is reduced to flour in the fine-milling region of the millstone faces. The pass-through period does, thereby, automatically adjust to the size of the feedstock grains, achieving the desired prevention of excessive heating of the feed.

A multiple fracture of kernels is made possible if the spiral groove narrows toward the milling gap, forcing ever smaller fragments against the radial flutes in the opposing face. The groove is advantageously provided in the lower millstone which rotates with respect to the stationary upper stone; the weight of the feedstock tending to keep it properly in the groove and to facilitate its outward transport. A further improvement in the shearing action to which the kernels, or fragments thereof, are subjected may be achieved by canting the alignment of the co-operating flutes from a purely radial direction into an angled one, opposing the curvature of the spiral groove.

In yet a further development of the millstones of the invention, spiral furrows may be provided in the fine-milling region thus resulting in an increased pass-through time for the milled material without necessitating a corresponding increase in the outer diameter of the stones. This increment in the working time reduces the danger of overheating the feedstock, even when it is to be ground into an extremely fine flour.

A particular advantageous form of this development results when these spiral furrows are curved in opposing senses in the two millstones; the shearing action on the milled material is improved and the power required to drive the milling apparatus reduced. This is of great advantage in manually operated mills. With strongly curved furrows in both millstones the number of opposing, intersecting edges is greatly increased and the points of intersection travel progressively outward, leading to very effective milling action.

The milling surface of each millstone may contain a plurality of spiral furrows to increase the number of the points of intersection. Furthermore, the slope of the spirals may be reduced toward the outer periphery of the millstones, thereby increasing the relative residence time, as the material is moved from the center radially outward, in the region of greatest potential heating.

To favor the uniform reduction of the feed grain in the fine-milling region of the millstones, the depth of the spiral furrows may be reduced toward their outer peripheries; branching of the furrows near the periphery — into at least two furrows each — may also be used for similar purposes. These measures tend to distribute the partially reduced feed grains over the fine-milling region of the millstones uniformly and to improve the operation thereof.

The supply of partially ground meal to the fine-milling region of the milling apparatus is automatically controlled, in terms of quantity, by the action of the pre-milling devices — the kernel-breaking hob, or the coarse-grinding spiral groove — so that a stoppage of the milling gap becomes unlikely. The larger kernels must be broken individually and the fragments supplied to the fine-milling section, while smaller kernels are fed directly to the fine-milling region but provide a lesser quantity of meal for a greater number of grains.

A positive means of controlling the quantity of grain reaching the fine-milling region is provided in another embodiment of the invention. In this embodiment the central, substantially cylindrical cavity from which the meal is supplied to the gap between the two millstones is replaced by an annular cavity spaced from the centerline of the driveshaft, with at least one metering channel leading from the central orifice of the upper millstone to the annular cavity.

Accordingly, the feedstock is not fed directly from the central orifice into the distribution cavity but must first pass through a region in which the opposing surfaces of the two millstones are in close proximity to one another, by means of the aforementioned metering channel, or channels. When a premilling hob is fitted, the material passes through a size-reducing stage prior to entering these metering channels. By varying the number and passage area of the metering channels the amount of feed supplied to the fine-milling region of the millstones can be accurately pre-determined. This metering function does not require any additional parts; since the millstones are commonly manufactured by casting, the forming of the metering channels of the invention does not lead to an increased cost of manufacture. This observation also applies to the previously described spiral grooves for pre-milling and to the provision of spiralling furrows in the fine-milling region.

The provision of metering channels in the millstones does, however, negate the requirement for external control elements. Such control elements of the prior art have taken the form, for example, of feedworms built into the central orifice of the upper millstone, necessitating an increased thickness of that part, especially when a pre-milling hob is also provided in that orifice.

The forming of the metering channels in a spiral fashion facilitates the entry of the feedstock, or pre-milled grain, thereinto and provides for a reliable supply therethrough. The metering channel, or channels are preferably of a constant depth in the region between the edge of the central supply orifice and the annular cavity from which it is fed into the fine-milling region. A uniform transport of feedstock is assured by the constant depth of the channels.

Since it is not intended that any milling action take place in the metering channels, it is sufficient if they are provided in their entirety in the lower millstone. The entrance of the feed grains into the channels is also facilitated if the inner ends thereof overlap by some distance the central supply orifice in the upper millstone. With such an arrangement the grains can drop directly into the metering channels from above.

BRIEF DESCRIPTION OF THE ACCOMPANYING DRAWINGS

The preferred embodiment of the invention is illustrated in the accompanying drawings, in which:

FIG. 6 is a frontal view of a millstone according to another embodiment of the invention;

FIG. 7 is a transverse section through a pair of millstones of the embodiment of FIG. 6;

FIG. 8 is a transverse section through the millstone pair of FIG. 7, shown in a relative angular position rotated from that of FIG. 7;

FIG. 9 is a frontal aspect of a millstone with three concentric spiral furrows;

DESCRIPTION OF THE PREFERRED EMBODIMENT

Figure 1:
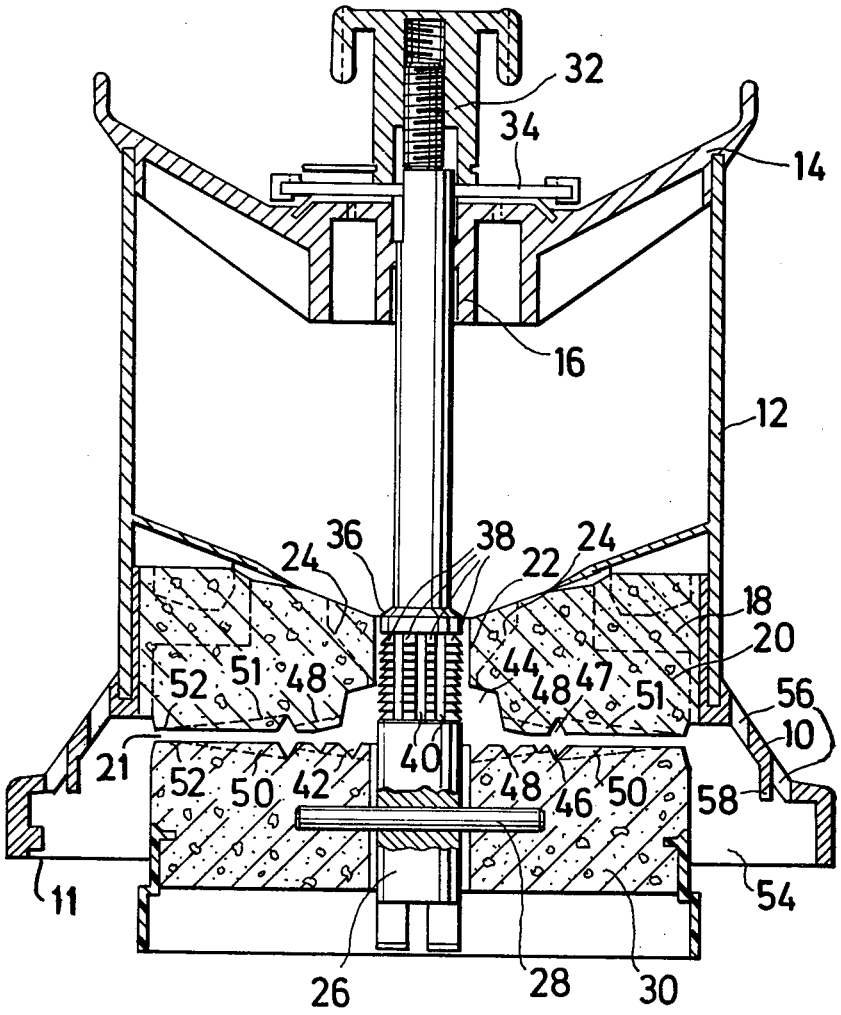
FIG. 1 is a transverse section through a mill constructed according to the invention and provided with a pre-milling hob on the driveshaft of the lower millstone.

FIG. 1 shows a mill constructed according to the principles of the invention with a lower housing 10, a supply chamber 12 surmounting the lower housing, and a cover 14 for the supply chamber. The cover 14 is shaped in a downward cone and its surface is pierced by openings in the form of circular segments interrupted by spoke-like gussets. The openings are used to charge feedstock into the supply chamber 12 whose bottom acts as a filling funnel for the mill. The gussets of the cover 14 carry a central portion 16 which bears, in a manner to be more fully described below, the driveshaft of the mill.

The lower housing 10 sits, with its lower edge 11, upon a receiving container for the flour; the container is not shown for the sake of clarity of illustration. The housing 10 also bears integral flying buttresses 18 which secure an upper millstone 20, cast in situ, against rotation. The upper millstone closes off the lower face of the funnel-like supply chamber 12.

Figure 2:
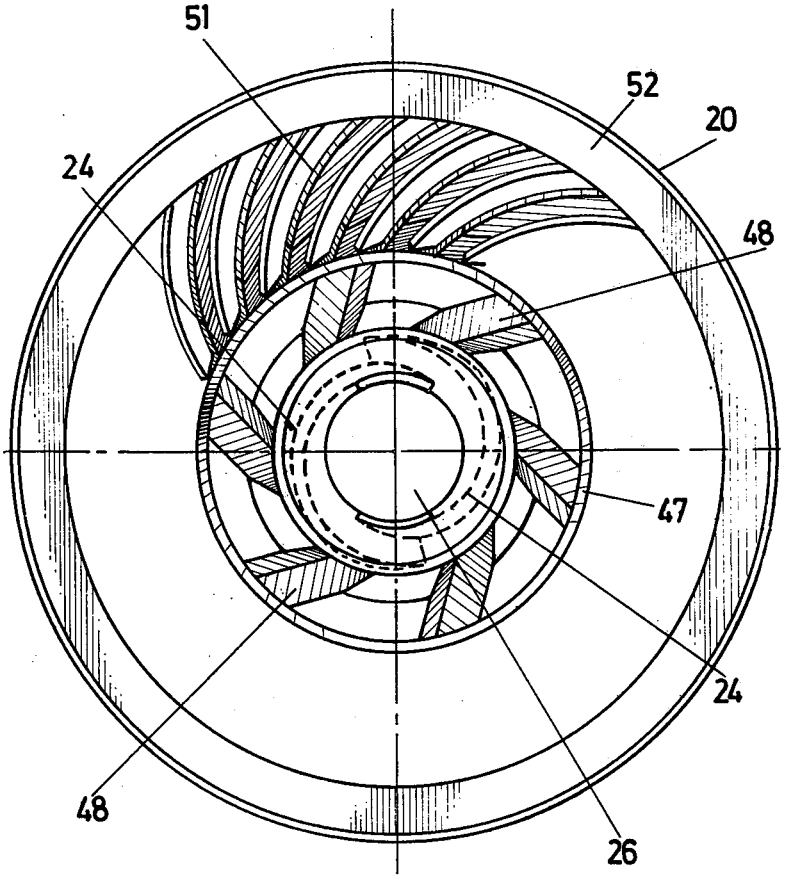
FIG. 2 is a plan view of the milling face of the upper, stationary millstone of the embodiment of FIG. 1.

The upper surface of the millstone 20 is also shaped in the form of a funnel and angles off into a supply orifice 22 centrally disposed in the millstone. Two feed slots 24 are formed in the wall of the supply orifice 22. The feedslots 24 start at the upper end of the orifice 22 and have an initial cross-section which corresponds to the largest possible kernal size of the grain to be milled. From the upper end of the orifice 22 the feedslots 24 run downwardly in a spiral in the inner periphery of the orifice 22. The cross-section of the feedslots 24 narrows as they proceed downward until the feedslots 24 completely disappear at the lower end of the orifice 22. This characteristic of the feedslots 24 is shown in FIGS. 1 and 2.

A lower millstone 30 is borne on a crosspin 28 passing through driveshaft 26; the crosspin secures the shaft and the millstone 30 into a jointly rotating assembly. The driveshaft 26 rises through the supply orifice 22 of the upper millstone 20 and through an opening in the central cover portion 16. That portion of the shaft 26 above the cover 16 is threaded and engaged by an adjusting nut 32; the nut 32 bears on a thrust bearing plate 34 supported on the cover portion 16. By relative rotation of the nut 32 and the shaft 26 the spacing between the upper and nether millstones 20 and 30 may be adjusted to provide a desired milling gap 21.

In the region of the supply orifice 22 of the upper millstone 20, a hob 36 is formed on the driveshaft 26; the length of the hob 36 corresponding substantially to the thickness of the millstone 20. The hob comprises a large number of teeth 38 jutting peripherally from the surface of the driveshaft in parallel planes orthogonal to the centerline of the shaft 26. The individual cutters, or teeth, 38 are each separated from the adjoining teeth by gaps; these gaps are aligned in the several planes in which the teeth are located in such a manner that they form a plurality of grooves 40 along lines parallel to the shaft centerline.

Figure 3:
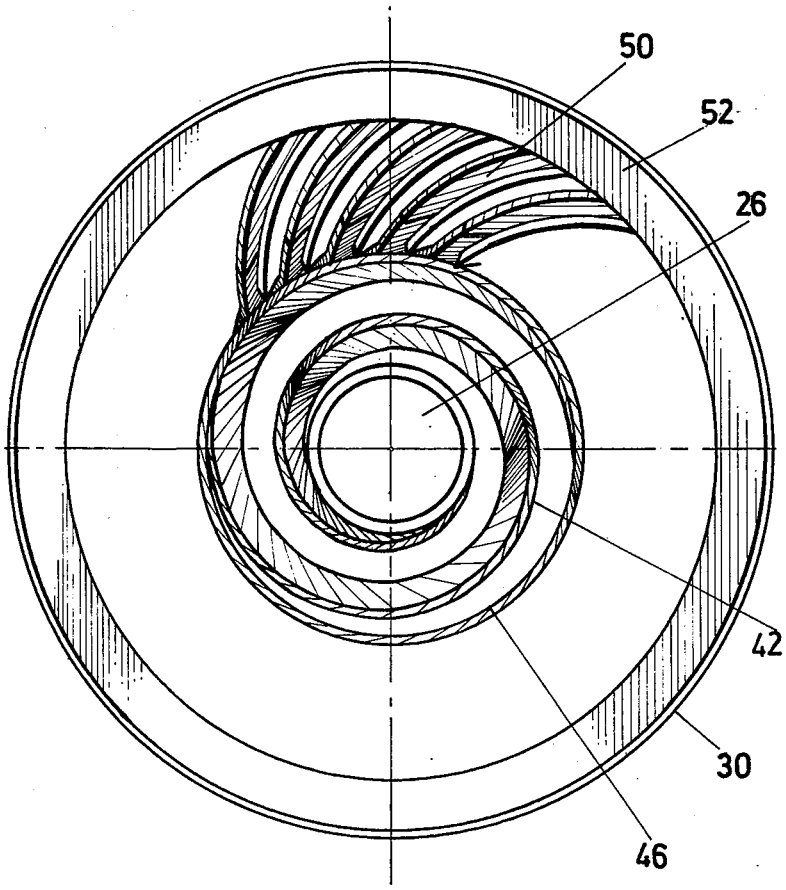
FIG. 3 is a plan view of the lower, rotating millstone of the embodiment of FIG. 1.

In the upper surface of the lower millstone 30, the surface turned toward the milling face of the upper millstone in the assembly, a spiral groove 42 is provided in the central portion of the surface. This spiral groove 42 leads from the outer edge of a supply cavity 44, into which the orifice 22 discharges, into a circular depression 46 intermediate between the center and the outer perimeter of the millstone 30, as shown in FIG. 3.

Opposite the spiral groove 42 a number of flutes 48 are provided in the lower face of the upper millstone 20, running from the supply cavity 44 toward a circular depression 47 coincident with the depression 46 of the lower millstone. The flutes 48 run substantially radially, but are, as shown in FIG. 2, slightly angled with respect to the true radii, so that they oppose the spiral of the groove 42.

The circular depression 46 in the midrange of the lower millstone 30 is adjoined by the fine-milling region with a large number of outwardly spiralling furrows 50. The furrows 50 become shallower as they approach the outer perimeter of the millstone. In a similar fashion, a plurality of spiral furrows 51 radiate from the circular depression 47 of the upper millstone 20; the furrows 51 are formed identically to the furrows 50 but their curvature runs counter in sense to the latter.

Exterior to the regions of the furrows 50 and 51, the lower and upper millstones 30 and 20 are also provided with superimposed flat surfaces 52, the spacing between which determines the milling gap 21 of the milling apparatus and which is adjustible by means of the nut 32.

The milling apparatus of FIG. 1, described above, operates in the following fashion:

The feedstock, which is to be reduced to flour, is poured through the openings provided in cover 14 into the funnel-like interior of the supply chamber 12. The sloping bottom of the chamber 12 guides the feedstock into the supply orifice 22 in the upper millstone 20. The kernels of the feed are fed down the spiralling supply grooves 24 in the wall of the orifice 22 until they are arrested by the narrowing gap between the grooves and the hob 36. The kernels so arrested drop into the next axial groove 40 in the hob, as it rotates into the appropriate alignment, and are broken by the advancing teeth 38 and reduced in size until they can fall through between the teeth 38 and the sidewalls of the feed slots 24. One, or more, reductions in the size of the kernels produce pieces small enough to pass through the annulus between the outer periphery of the hob 36 and the orifice 22, into the supply cavity 44. The pre-milled feedstock lands in the spiral groove 42 of the lower, rotating millstone and is conveyed radially outwardly as they are further reduced in size by shearing between the edges of the groove 42 and of the flutes 48 in the upper millstone 20, above.

The, now much smaller, feed passes into the furrows 50 and 51 via the circular depressions 46 and 47 which form a toroidal chamber in the interface between the two millstones. The feed is further reduced in size by the action of the furrows 50 and 51 and passes into the region of the milling space defined by flat portions 52 of the millstones, where it is finally reduced to a size corresponding to the milling gap 21.

The milled flour exits radially into a circular chamber 54 defined by the lower housing 10, whence it falls into a receptacle upon which the housing 10 is supported. Upwardly directed vents 56 allow for the unrestricted discharge of air retained in the flour; they are inwardly protected by a deflector ring 58, so that the flour cannot escape via the vents 56. The deflector ring 58 sits at the inner edge of the vents 56, and does, thereby, prevent the flour existing at the periphery of the millstones from passing through the vents 56. In the commonly utilized speed range, the flour leaves the gap 21 between the millstones with a very low velocity. The flour inpacting on the deflector ring 58, therefore, falls downward. Should a small proportion of the flour be deflected upward, it will strike the inner surface of the housing 10 adjoining the deflector ring 58, and will not, again, escape through the vents 56. The vents 56 serve only to equalize the pressure difference which may arise during the milling process.

Figure 4:
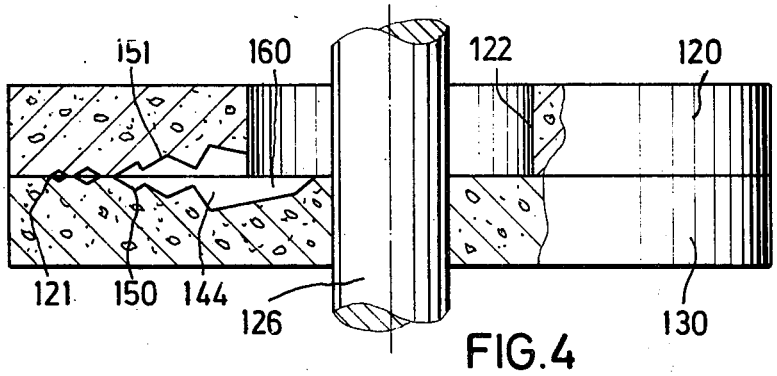
FIG. 4 is a transverse section, taken along section line IV—IV of FIG. 5 — of another embodiment of the paired millstones of the invention.
Figure 5:
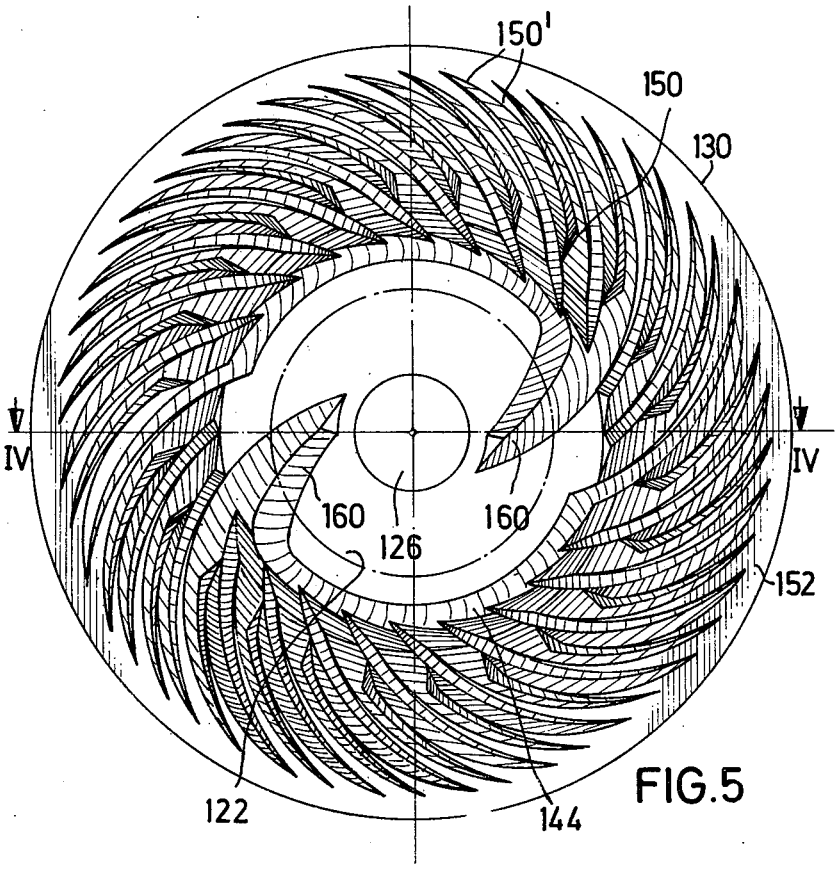
FIG. 5 is a plan view of the lower millstone of the embodiment of FIG. 4.

Another embodiment of the millstones of the invention is shown in the illustrating of FIGS. 4 and 5, incorporating a metering mechanism for the control of the amount of feed supplied to the fine-milling region of the millstones. While they are not directly illustrated, pre-milling devices, such as the hob 36 or the spiral groove 42 and its cooperating flutes 48 may also be provided with this embodiment but are omitted for clarity.

The assembly of FIG. 4 comprises a lower millstone 130 and an upper millstone 120, with the stone 130 rigidly affixed to a driveshaft 126, by means of which it rotated against the upper stone, which is stationary in a housing not shown.

A supply orifice 122 pierces the center of the upper millstone 120, the diameter of this orifice is indicated by broken outline in the view of FIG. 5 which shows the upper face of the lower millstone 130. Feedstock passes from a housing, through the orifice 122, and into the milling space between the superposed millstones.

The lower millstone 130, as shown in FIG. 5, differs from millstones of the prior art through its lack of a central supply cavity; a supply cavity 144 is provided, in the form of an annular depression in the upper surface of the stone, adjacent to a substantially flat surface portion underlying the orifice 122. The depressed supply cavity 144 is sufficiently removed from the driveshaft 126, that it is completely covered by the upper millstone 120 in the assembly.

A pair of metering channels 160 interconnect the base of the supply orifice 122 and the cavity 144 and control the transfer of grain. These metering channels begin in the flat surface portion underlying the orifice and spiral outwardly, discharging into the cavity 144. The curvature of the channels 160 is so chosen that, with the millstone 130 rotating in its normal sense, the grains falling thereinto are forced radially outward by their inertia and the frictional forces in the channels.

Exterior to the cavity 144, a number of spiral furrows 150 interrupt the surface of the millstone 130; their depth decreasing toward the outer edge of the stone. These furrows 150 are formed in a manner similar to furrows 50 of FIG. 3 but differ from those in branching into paired furrows 150' midway between the cavity 144 and the stone periphery. During the rotation of the millstone 130, opposite the stationary upper millstone 120, the cereal grains are fed from the cavity 144 into the furrows 150 where they are broken by shear forces exerted by the co-operating millstones, as the grain size is reduced the particles travel outwardly until they enter the furrows 150' whose function is to evenly distribute the already ground feed over the perimeter of the millstones.

In the stationary, upper millstone 120 corresponding furrows 151 are provided, also with reducing depth at increased radial distances. These furrows are formed with their curvature counter to the curvature of the furrows 150 in the lower millstone 130, whereby the milling action between the two bodies is improved, through the encounter by the partly milled grains of a large number of intersecting edges.

Beyond the outer limits of the spiralling furrows 150 and 151, the almost completely milled feedgrains pass through a fine-milling region defined by parallel, flat surface portions 152, prior to exiting from milling gap 121 at the outer perimeter.

Many variations are possible in the design of the above embodiment of the invention. In particular, the number and depth of the metering channels 160 can be adapted to the type and desired feedrate of the cereal. The metering channels may also be formed without the spiral alignment, though this promotes the transport of the feed into the supply cavity. It is also possible to provide the metering channels in the lower face of the upper millstone 120, opening directly from the sidewall of supply orifice 122, with the motion of the grain impelled by the rotation of the nether millstone. The form and arrangement of the metering channels 160, as shown in FIGS. 4 and 5 is preferred, due to the gravitational assist in admitting the grain thereto.

In FIGS. 6 through 10 additional embodiments of the millstones of the invention are illustrated. These embodiments show differing developments of the spiral furrows located in the finish milling region of the apparatus. It is understood that the pre-milling components of FIGS. 1 through 3, as well as the metering channels shown in FIGS. 4 and 5, may be equally adapted to the embodiments described below.

While the furrows 50 and 51, and corresponding furrows 150 and 151, of the previously described embodiments show only a negligible curvature of such furrows, and are present in large numbers, those furrows shown in FIGS. 6 through 11 show substantially greater curvature, and are present in much smaller numbers. Some of these embodiments incorporate furrows which describe a number of revolutions around the rotational axis of the mill, while others show only a single furrow in the fine-milling region, in particular in the embodiment shown in FIGS. 6, 7, 8, 10 and 11; the embodiment of FIG. 9 shows three furrows in each of the two millstones.

Turning now to FIG. 6 we see a millstone 220 with a peripheral, flat milling surface 252 and a central cavity 244. A supply orifice 222 leads directly into the cavity 244. A spiral furrow 251 extends — with constant incremental curvature — from the cavity 244 to the region 252 of the millstone 220.

Preferably the depth and/or the slope of the furrow 251 reduces toward the edge of the millstone 220.

A lower millstone 230 is provided to mate with the stone 220 of FIG. 6; the features of the lower millstone are, generally, the same as the upper millstone, but the direction of curvature of its furrows 250 is reversed in relation to the curvature of furrows 251.

FIG. 7 is a transverse section through the millstones 220 and 230 and indicates the counter-rotational direction of their respective furrows 251 and 250 with respect to one another. The relative position of the two millstones, as illustrated in FIG. 8, arises from a rotational displacement of the millstone 230 with respect to the position shown in FIG. 7.

FIG. 9 illustrates a further development of a millstone which, in contrast to the millstone 220 shown in FIG. 6, encompasses three concentrically spiralling furrows 251, 251' and 251''.

The furrows 251, 251' and 251'' also lead from the supply cavity 244 and extend to the outer perimeter of the millstone 220. The slope and/or the depth of the furrows may be reduced toward the perimeter — from the inside to the outside — as in the embodiment of FIG. 6. In principle the mating millstone 230 also shows a similar form, but with the furrows spiralling counter to the furrows in the millstone 220 of FIG. 9.

The millstones of the embodiment of FIG. 9 are also provided with a peripheral, flat fine-milling surface 252, as well as an orifice 222 in the upper stone leading to a central cavity 144.

Figure 10:
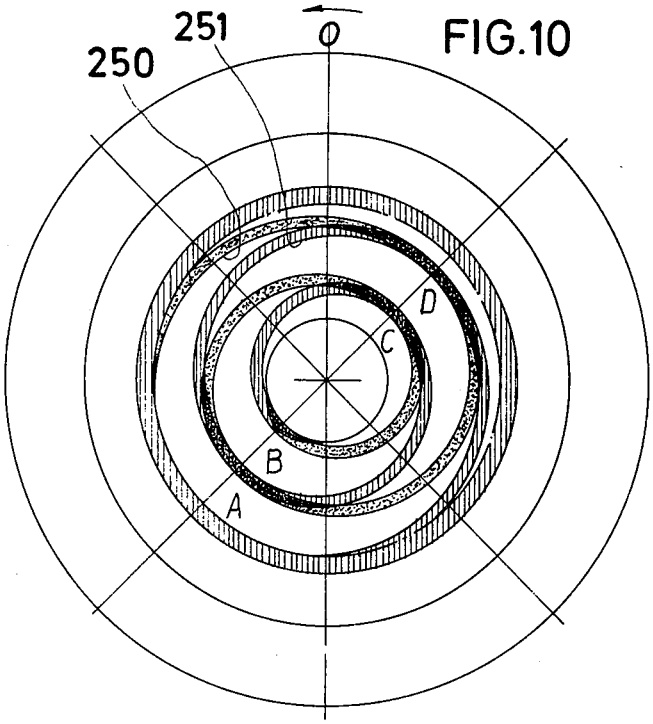
FIG. 10 is a schematic representation of the interaction of the spiral furrows of a millstone pair according to the embodiment of FIGS. 6, 7 and 8.
Figure 11:
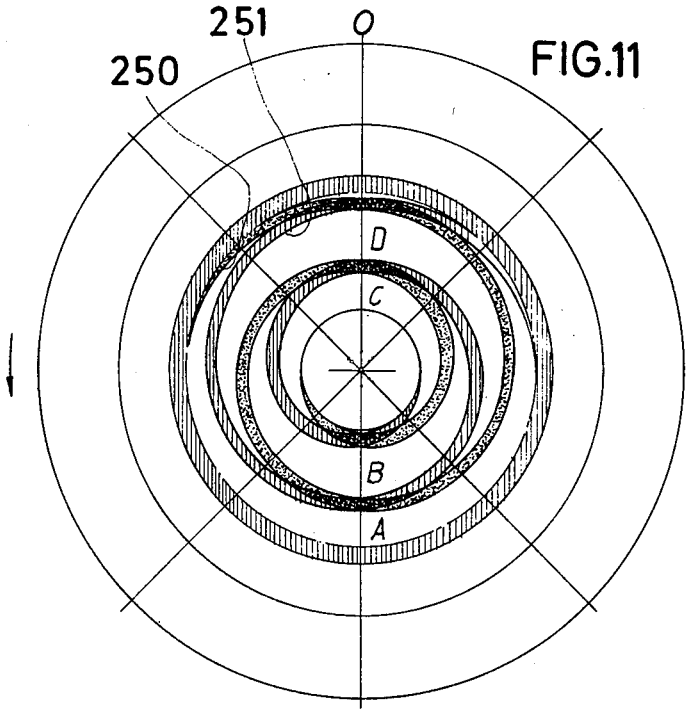
FIG. 11 is a schematic representation corresponding to that of FIG. 10, with the component millstones rotated relative to one another by approximately one eighth of a revolution.

FIGS. 10 and 11 illustrate the manner in which the crossings, or intersections, A, B, C, and D, of the cooperating furrows 250 and 251 travel outward when one of the stones is rotated in the direction of the arrow. In FIG. 11 the millstones 220 and 230 have been rotated, relative to one another, by 45°.

The spiral furrows 250 and 251 may be provided with a variety of cross-sections, including, for example, square, triangular, or trapezoidal sections.

In all embodiments of the invention the millstones may be manufactured by any of the methods of the prior art. A particularly simple and economical method applicable to the strongly sculptured milling faces of the stones of the invention, is the casting of ceramically bound abrasives into molds.

The invention has been described above with reference to its preferred embodiments, minor changes in the arrangement, spacing and forming of the several features of the milling apparatus of the invention shall be deemed to be encompassed by the disclosure herein: the scope of the invention being delimited only by the appended claims.

For example, it is possible to provide the opposing milling surfaces of the paired millstones with shapes other than planar, in particular they may be formed in conical shapes. In such an embodiment one millstone would have a conically convex milling face, while the mating stone would be provided with a milling face in the form of a funnel.

I claim:

1. An apparatus for the milling of feedstocks, including an upper millstone, rigidly held in a housing and provided with a central opening for the admission of said feedstock, and a lower millstone, rotatably secured to a driveshaft, having a pre-milling means for the reduction in size of said feedstock prior to the entry thereof into the fine-milling region between said millstones, said pre-milling means comprising:

a hob mounted on an extension of said driveshaft and being situated in said central opening;

cutters, located on said hob, jutting out from the surface of said driveshaft and being substantially at right angles thereto, said cutters being separated by gaps; and at least one feedslot in the wall of said central opening narrowing in the direction of feed travel.

2. The apparatus of claim 1, wherein said gaps between the cutters are aligned into at least one continuous groove along said hob, and along the centerline of said driveshaft.

3. The apparatus according to claim 1, wherein said gaps form a groove parallel to the centerline of said driveshaft and wherein said feedslots descend in a helical path in the wall of said central opening.

4. The apparatus according to claim 1, wherein the width of the gaps between the cutters corresponds to the diameter of the largest kernals in said feedstock.

5. The apparatus according to claim 1, wherein said lower millstone has a spiral groove extending from a central cavity to said fine-milling region; and said upper millstone has substantially radial flutes extending from said central cavity to said fine-milling region.

6. The apparatus of claim 1, wherein said lower millstone has a spiral groove extending from a central cavity to said fine-milling region, said spiral groove having a continuously diminishing cross-section as it extends toward said fine-milling region; and said upper millstone has substantially radial flutes extending from said central cavity to said fine-milling region.

7. The apparatus according to claim 1, wherein said lower millstone has a spiral groove extending from a central cavity to said fine-milling region; and said upper millstone has substantially radial flutes extending from said central cavity to said fine-milling region, said substantially radial flutes being canted against the curvature of said spiral groove.

8. The apparatus according to claim 1, wherein said millstones are provided with spiral furrows in said fine-milling region.

9. The apparatus of claim 8, wherein the spiral furrows on each of said millstones are curved in opposite senses.

10. The apparatus of claim 8 wherein the milling surface of each of said millstones is provided with a plurality of furrows.

11. The apparatus according to claim 8, wherein the slope of said furrows diminishes as they extend toward the periphery of said millstones.

12. The apparatus according to claim 8, wherein the depth of said spiral furrows diminishes as they extend toward the periphery of said millstones.

13. The apparatus according to claim 8, wherein said spiral furrows branch into at least a pair of furrows at a point between a central cavity and the periphery of said millstone, said pair of furrows continuing toward the periphery of said millstones.

14. The apparatus according to claim 1, wherein the co-operating surfaces of said pair of millstones are conically formed.

15. The apparatus according to claim 1, further including a supply cavity located between said millstones, from whence said feedstock is fed between said millstones, and radially displaced from said central opening and connected therewith by at least one metering channel.

16. The apparatus according to claim 15, wherein said at least one metering channel is of a spiral configuration.

17. The apparatus according to claim 15, wherein the depth of said at least one metering channel is constant between the edge of the central opening and the supply cavity.

18. The apparatus of claim 1, further including a supply cavity located between said millstones, from whence said feedstock is fed between said millstones, radially displaced from said central opening and connected therewith by at least one metering channel provided in the surface of said lower millstone.

19. The apparatus of claim 18, wherein the orifice of said central opening in the upper millstone overlaps partially that portion of said lower millstone wherein said at least one metering channel is provided.

* * * * *